US005438830A

United States Patent [19]

Matsumura

[11] Patent Number: 5,438,830

[45] Date of Patent: Aug. 8, 1995

[54] EXHAUST SYSTEM OF INTERNAL COMBUSTION ENGINE

[75] Inventor: Hiroatsu Matsumura, Ebina, Japan

[73] Assignee: Nissan Motor Co., Ltd., Yokohama, Japan

[21] Appl. No.: 234,360

[22] Filed: Apr. 28, 1994

[30] Foreign Application Priority Data

Jun. 16, 1993 [JP] Japan ..... 5-145196

[51] Int. Cl.[6] ..... F01N 3/28

[52] U.S. Cl. ..... 60/302

[58] Field of Search ..... 60/302

[56] References Cited

U.S. PATENT DOCUMENTS 5,144,800 9/1992 Shioya ..... 60/302

5,239,826 8/1993 Hirota ..... 60/302

FOREIGN PATENT DOCUMENTS 3-114522 U 11/1991 Japan .

*Primary Examiner*—Douglas Hart

*Attorney, Agent, or Firm*—Foley & Lardner

[57] ABSTRACT

An exhaust system of a transverse V-type or horizontal opposed type engine having front and rear cylinder banks includes: front and rear exhaust pipes which are respectively provided for the front and rear cylinder banks; front and rear catalytic converters which are respectively connected to the front and rear exhaust pipes; a joint exhaust pipe which is connected to the front and rear catalytic converters for collecting exhaust gas from the front and rear catalytic converters; and a combined exhaust pipe which is connected to the joint exhaust pipe. The combined exhaust pipe has a longitudinal axis which is substantially parallel to a longitudinal axis of the rear catalytic converter such that exhaust gas flow in the rear catalytic converter is in the substantially opposite direction to exhaust gas flow in the combined exhaust pipe. Each of the front and rear catalytic converters has an elliptical section. A major axis of the elliptical section of the rear catalytic converter is inclined at a certain angle relative to the combined exhaust pipe.

4 Claims, 5 Drawing Sheets

EXHAUST SYSTEM OF INTERNAL COMBUSTION ENGINE

BACKGROUND OF THE INVENTION

1. Field of the Invention

The present invention relates to an exhaust system of a transverse V-type or horizontal opposed type engine.

2. Description of the Prior Art

In order to clarify the task of the present invention, one conventional exhaust system of a transverse V-type or horizontal opposed type engine will be outlined with reference to FIGS. 8 to 10 of the accompanying drawings.

As is seen from FIG. 8, the exhaust system comprises front and rear exhaust pipes (not shown) which are respectively provided for front and rear cylinder banks of the engine, front and rear catalytic converters (only rear catalytic converter 10 is shown) which are respectively connected to the front and rear exhaust pipes, a junction exhaust pipe 12 connected to the front and rear catalytic converters, and a combined exhaust pipe 14 which is connected to a muffler (not shown). The combined exhaust pipe 14 is arranged parallel to the rear catalytic converter 10 so that the exhaust gas flow in the rear catalytic converter 10 is in the opposite direction to that in the combined exhaust pipe 14.

As is seen from FIG. 9, the rear catalytic converter 10 has an elliptical section. The front catalytic converter also has an elliptical section. The major axis $L_1$ of the elliptical section of the rear catalytic converter 10 is horizontally arranged, and thus directed toward the combined exhaust pipe 14. However, this conventional exhaust system has an increased exhaust loss and uneven utilization of a catalyst of the rear catalytic converter 10.

JP (Utility Model) 3-114522 A (1991) discloses an exhaust system of an internal combustion engine, which is substantially similar to the above-mentioned conventional exhaust system. That is, this publication also discloses a rear catalytic converter of which elliptical section has the horizontally arranged major axis.

SUMMARY OF THE INVENTION

It is therefore an object of the present invention to provide an exhaust system of a transverse V-type or horizontal opposed type engine, which is low in exhaust loss and enables more uniform flow of exhaust gas in the rear catalytic converter.

According to the present invention, there is provided an exhaust system of a transverse V-type or horizontal opposed type engine having front and rear cylinder banks, said exhaust system comprising:

front and rear exhaust pipes which are respectively provided for the front and rear cylinder banks;

front and rear catalytic converters which are respectively connected to said front and rear exhaust pipes, each of said front and rear catalytic converters having an elliptical section;

a joint exhaust pipe which is connected to said front and rear catalytic converters for collecting exhaust gas from said front and rear catalytic converters; and a combined exhaust pipe which is connected to said joint exhaust pipe, said combined exhaust pipe having a longitudinal axis which is substantially parallel to a longitudinal axis of said rear catalytic converter such that exhaust gas flow in said rear catalytic converter is in the substantially opposite direction to exhaust gas flow in said combined exhaust pipe, wherein a major axis of the elliptical section of said rear catalytic converter is inclined at a certain angle relative to said combined exhaust pipe.

DESCRIPTION OF THE PREFERRED EMBODIMENTS

With reference to FIGS. 1 to 7, an exhaust system according to the present invention for a transverse V-type or horizontal opposed type engine will be described in the following.

Figure 1:
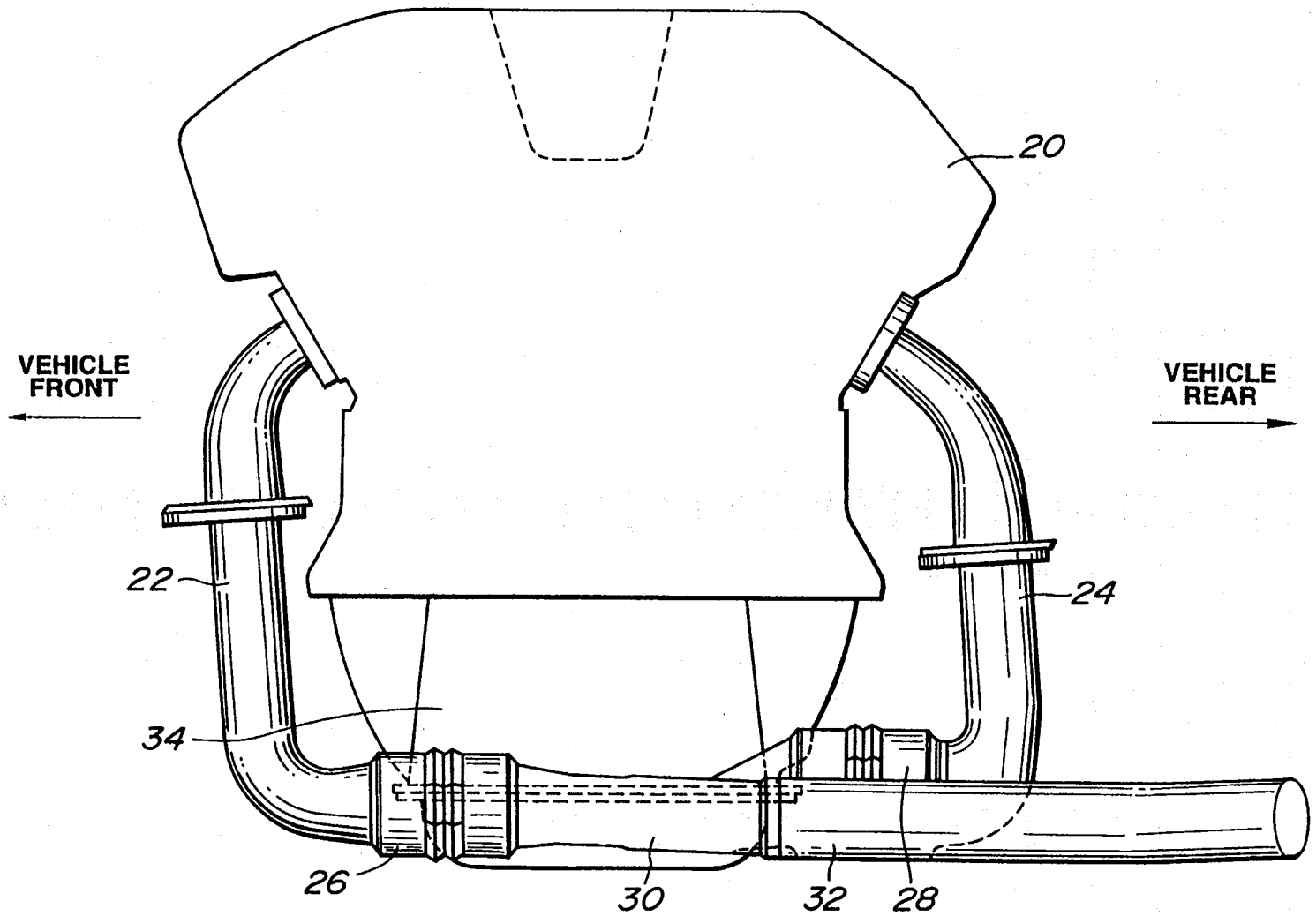
FIG. 1 is an elevational view of an exhaust system according to the present invention, which is connected to a transverse V-type engine.
Figure 2:
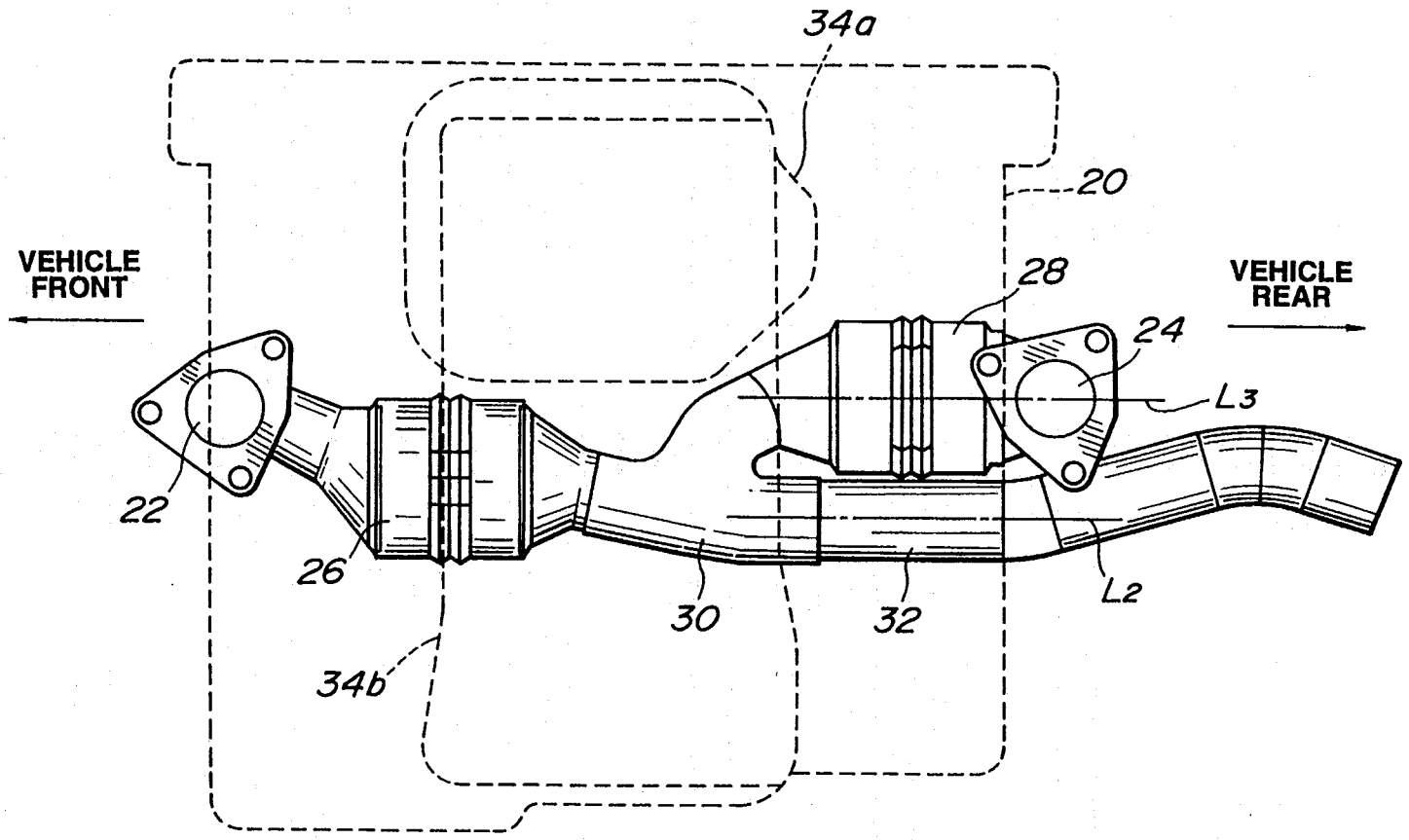
FIG. 2 is a plan view of the exhaust system according to the present invention, which is connected with the engine drawn with a dotted line.

As is seen from FIGS. 1 and 2, designated by numeral 20 is a transverse V-type engine having front and rear cylinder banks having a certain angle relative to each other.

The exhaust system according to the present invention comprises front and rear exhaust pipes 22, 24 which are respectively provided for the front and rear cylinder banks, front and rear catalytic converters 26, 28 which are respectively connected to the front and rear exhaust pipes, a junction exhaust pipe 30 connected to the front and rear catalytic converters 26, 28, and a combined exhaust pipe 32 which extends rearwardly and is connected to the junction exhaust pipe 30 and a muffler (not shown).

As is seen from FIG. 2, the junction exhaust pipe 30 is positioned away from a first portion 34*a* of an oil pan 34, which is deep in depth, and below a second portion 34*b* of the oil pan 34, which is shallow in depth. The junction exhaust pipe 30 is configured such that the combined exhaust pipe 32 is arranged parallel to the rear catalytic converter 28. That is, a longitudinal axis $L_2$ of the combined exhaust pipe 32 is parallel to a longitudinal axis $L_3$ of the rear catalytic converter 28 so that the exhaust gas flow in the rear catalytic converter 28 is in the opposite direction to that in the combined exhaust pipe 32. The junction exhaust pipe 30 is further configured such that a longitudinal axis of the front catalytic converter 26 and that of the combined exhaust pipe 32 are substantially in a straight line. Therefore, exhaust gas from the front catalytic converter 26 goes substantially straight into the combined exhaust pipe 32.

As is seen from FIG. 1, the front and rear catalytic converters 26, 28 and the combined exhaust pipe 32 have bottom surfaces which are substantially the same in height.

Figure 4:
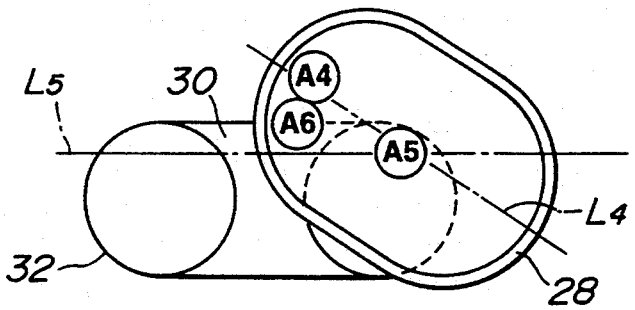
FIG. 4 is a sectional view taken along the line X—X of FIG. 3.
Figure 5:
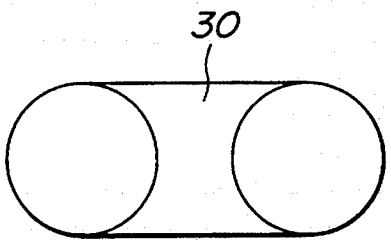
FIG. 5 is a sectional view taken along the line Y—Y of FIG. 3.

As is seen from FIG. 4, the rear catalytic converter 28 has an elliptical section. The front catalytic converter 26 also has an elliptical section. It should be noted that the major axis $L_4$ of the elliptical section of the rear catalytic converter 28 is inclined at a certain angle to a horizontal line $L_5$. In other words, the major axis $L_4$ of the elliptical section of the rear catalytic converter 28 is inclined at the certain angle to the combined exhaust pipe 32.

Figure 9:
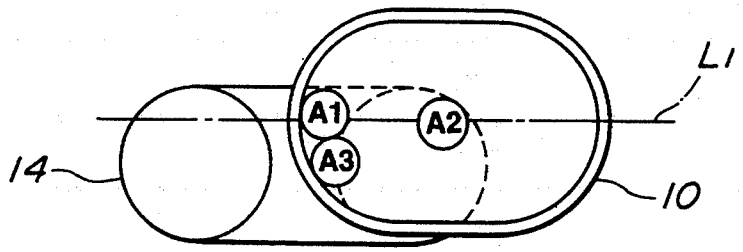
FIG.9 (PRIOR ART)
FIG. 9 is a sectional view taken along the line P—P of FIG. 8.
Figure 10:
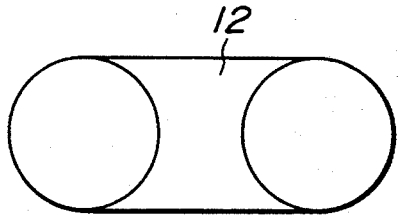
FIG.10 (PRIOR ART)
FIG. 10 is a sectional view taken along the line Q—Q of FIG. 8.

In fact, the rear catalytic converter 10 of the above-mentioned conventional exhaust system is rotated by the certain angle in a clockwise direction in FIG. 9 round its longitudinal axis to provide the rear catalytic converter 28 according to the present invention.

In the following, with reference to FIGS. 3 to 9, exhaust loss of the exhaust system according to the present invention will be compared with that of the above-mentioned conventional exhaust system.

Figure 8:
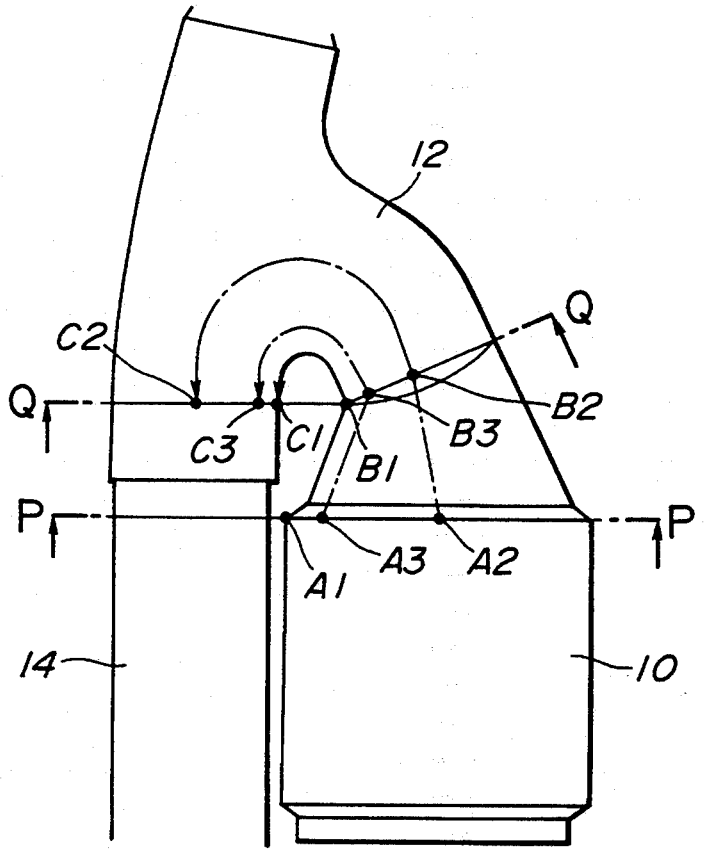
FIG.8 (PRIOR ART)
FIG. 8 is a view similar to FIG. 3, but showing the conventional exhaust system.

As is seen from FIGS. 8 and 9, three positions, A1, A2 and A3, are selected to evaluate exhaust loss of the conventional exhaust system. The position A1 is on the major axis $L_1$ of the elliptical section of the rear catalytic converter 10. The position A2 is on the center of the elliptical section. The position A3 is below the position A1 (see FIG. 9). The position A3 is closer to the position A2 than the position A1 is in terms of a horizontal direction (see FIG. 8). As is seen from FIG. 8, exhaust gas passing through the position A1 flows along a first flow path (A1→B1→C1). Exhaust gas passing through the position A2 flows along a second flow path (A2→B→C). Exhaust gas passing through the position A3 flows along a third flow path (A3→B3→C3).

Figure 3:
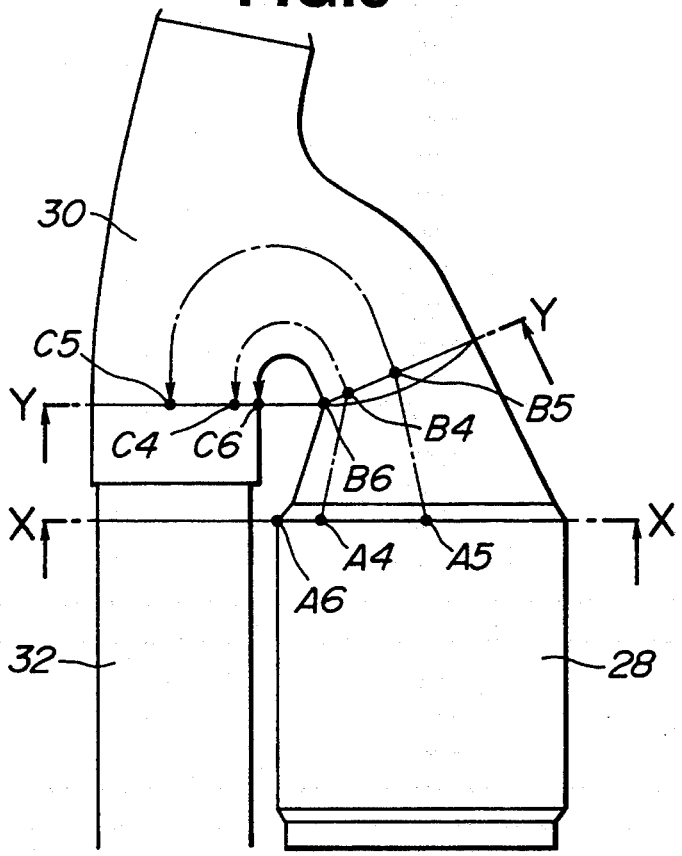
FIG. 3 is a plan view of an essential part of the exhaust system according to the present invention.

As is seen from FIGS. 3 and 4, three positions, A4, A5 and A6, are selected to evaluate exhaust loss of the exhaust system according to the present invention. With reference to FIGS. 4 and 9, when the rear catalytic converter 10 of the above-mentioned conventional exhaust system is rotated by the certain angle in a clockwise direction in FIG. 9 round its longitudinal axis or the position A2 to provide the rear catalytic converter 28 according to the present invention, the positions A1, A2 and A3 are moved to the positions A4, A5 and A6, respectively. Therefore, the position A4 is on the major axis $L_4$ of the elliptical section of the rear catalytic converter 28. The position A5 is on the center of the elliptical section. In other words, the positions A2 and A5 are exactly the same. The position A6 is below the position A4 (see FIG. 4). The position A6 is farther from the position A5 than the position A4 is in terms of a horizontal direction (see FIG. 3). As is seen from FIG. 3, exhaust gas passing through the position A4 flows along a fourth flow path (A4→B4→C4). Exhaust gas passing through the position A5 flows along a fifth flow path (A5→B5→C5). Exhaust gas passing through the position A6 flows along a sixth flow path (A6→B6→C6).

Figure 6:
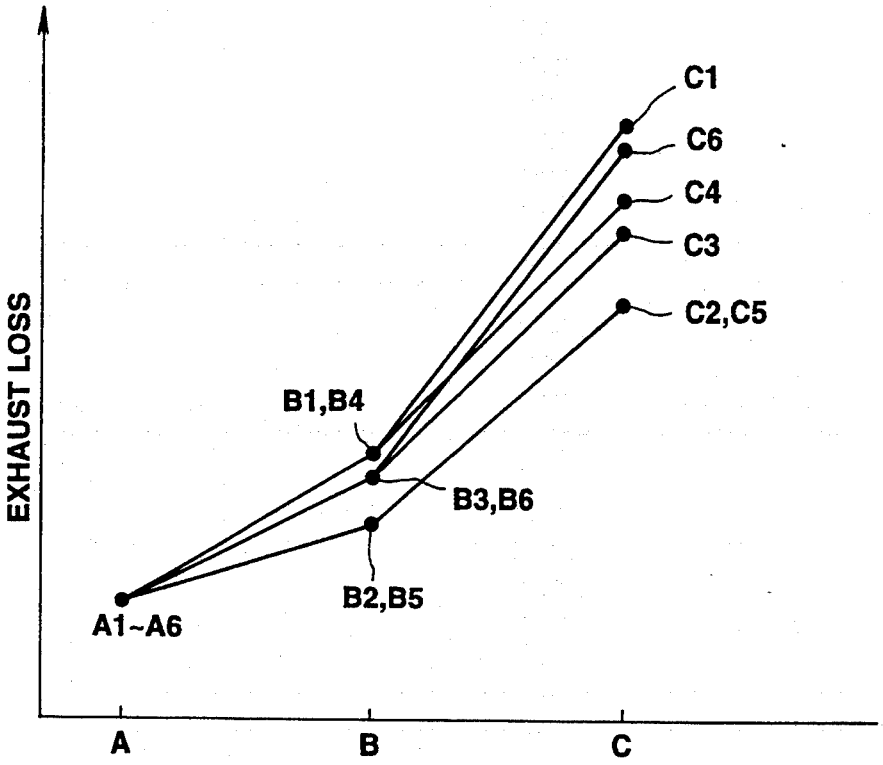
FIG. 6 is a schematic graph showing exhaust losses of three representative flow paths of the exhaust system according to the present invention and those of-three representative flow paths of a conventional exhaust system.

With reference to FIG. 6, exhaust losses of the fourth, fifth and sixth flow paths according to the exhaust system of the present invention will be compared in the following with the first, second and third flow paths according to the conventional exhaust system, respectively. In FIG. 6, it is assumed that all of exhaust losses at the positions A1 to A6 are the same.

Radius of curvature of the fourth flow path becomes larger than that of the first flow path because the position A1 is moved to the position A4 by the rotation of the conventional rear catalytic converter by the certain angle round the position A2 (see FIGS. 4 and 9). Therefore, exhaust loss of the fourth flow path is smaller than that of the first flow path. This is supported by that exhaust loss at the position C4 is smaller than that at the position C1 in FIG. 6. Radius of curvature of the fifth flow path is exactly the same as that of the second flow path. Therefore, as is shown in FIG. 6, exhaust loss of the fifth flow path is exactly the same as that of the second flow path. Radius of curvature of the sixth flow path becomes smaller than that of third flow path. Therefore, exhaust loss of the sixth flow path is larger than that of the third flow path. This is supported by that exhaust loss at the position C6 is larger than that at the position C3 in FIG. 6.

Figure 7:
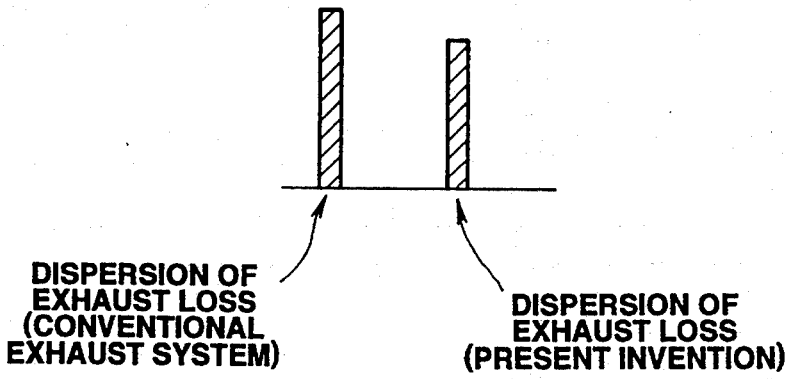
FIG. 7 is a schematic bar graph showing dispersion of exhaust loss of the exhaust system according to the present invention and that of the conventional exhaust system.

With reference to FIG. 6, in comparison between exhaust losses at the positions B4, B5 and B6 and exhaust losses at the positions B1, B2 and B3, variation or dispersion of the former is the same as that of the latter. In comparison between exhaust losses at the positions C4, C5 and C6 and exhaust losses at the positions C1, C2 and C3, dispersion of the former is smaller than that of the latter. As is shown in FIG. 7, this means that dispersion of exhaust loss of the exhaust system of the present invention is smaller than that of the conventional exhaust system. With this, according to the present invention, exhaust gas is allowed to more uniformly flow through the rear catalytic converter 28. Therefore, according to the present invention, conversion efficiency and utilization of catalyst are increased. With this, according to the present invention, if necessary, capacity of the rear catalytic converter can be reduced.

Furthermore, as is seen from FIG. 6, the maximum exhaust loss according to the conventional exhaust system is at the position C1. On the other hand, the maximum exhaust loss according to the exhaust system of the present invention is at the position C6. Exhaust loss at the position C6 is smaller than that at the position C1. It should be noted that this reduction with respect to the maximum exhaust loss significantly contributes to the reduction of the average value of exhaust loss of the exhaust system. With this, according to the present invention, exhaust resistance is reduced, thereby improving output of the engine.

What is claimed is:

1. An exhaust system of a transverse V-type or horizontal opposed type engine having front and rear cylinder banks, said exhaust system comprising:

front and rear exhaust pipes which are respectively provided for the front and rear cylinder banks;

front and rear catalytic converters, which are respectively connected to said front and rear exhaust pipes, each of said front and rear catalytic converters having an elliptical section;

a joint exhaust pipe which is connected to said front and rear catalytic converters for collecting exhaust gas from said front and rear catalytic converters; and a combined exhaust pipe which is connected to said joint exhaust pipe, said combined exhaust pipe having a longitudinal is axis which is substantially parallel to a longitudinal axis of said rear catalytic converter such that exhaust gas flow in said rear catalytic converter is in the substantially opposite direction to exhaust gas flow in said combined exhaust pipe, wherein a major axis of the elliptical section of said rear catalytic converter is inclined at a certain angle relative to said combined exhaust pipe.

2. An exhaust system of a transverse V-type or horizontal opposed type engine having front and rear cylinder banks, said exhaust system comprising:

front and rear exhaust pipes which are respectively provided for the front and rear cylinder banks;

front and rear catalytic converters which are respectively connected to said front and rear exhaust pipes, each of said front and rear catalytic converters having an elliptical section;

a joint exhaust pipe which is connected to said front and rear catalytic converters for collecting exhaust gas from said front and rear catalytic converters; and a combined exhaust pipe which is connected to said joint exhaust pipe, said combined exhaust pipe having a longitudinal axis which is substantially parallel to a longitudinal axis of said rear catalytic converter such that exhaust gas flow in said rear catalytic converter is in the substantially opposite direction to exhaust gas flow in said combined exhaust pipe, wherein a major axis of the elliptical section of said rear catalytic converter is inclined at a certain angle relative to a horizontal line.

3. An exhaust system according to claim 2, wherein said front and rear catalytic converters and said combined exhaust pipe have bottom surfaces which are substantially the same in height.

4. An exhaust system according to claim 2, wherein said junction exhaust pipe is configured such that a longitudinal axis of said front catalytic converter and the longitudinal axis of said combined exhaust pipe are substantially in a straight line.

* * * * *